United States Patent [19]

Olivieri

[11] 4,223,900

[45] Sep. 23, 1980

[54] BLADE FOR ICE SKATES

[75] Inventor: Icaro Olivieri, Montebelluna, Italy

[73] Assignee: Iceslj A.G., Vaduz, Liechtenstein

[21] Appl. No.: 910,625

[22] Filed: May 30, 1978

[51] Int. Cl.[2] ..... A63C 1/32

[52] U.S. Cl. ..... 280/11.12; 280/11.18

[58] Field of Search ..... 280/11.12, 11.17, 11.18

[56] References Cited

U.S. PATENT DOCUMENTS

| | | | |
|---|---|---|---|
| 1,115,790 | 11/1914 | Drevitson | 280/11.17 |
| 3,212,786 | 10/1965 | Florjanic et al. | 280/11.12 |
| 4,088,335 | 5/1978 | Norton et al. | 280/11.18 |

FOREIGN PATENT DOCUMENTS

| | | | |
|---|---|---|---|
| 585720 | 10/1959 | Canada | 280/11.17 |
| 2323090 | 12/1973 | Fed. Rep. of Germany | 280/11.12 |

*Primary Examiner*—John J. Love
*Assistant Examiner*—Milton L. Smith
*Attorney, Agent, or Firm*—George E. Kersey

[57] ABSTRACT

A blade for ice skating having a transverse, longitudinally extending passageway, desirably centrally located, and at least one longitudinally extending structural configuration for securely and partially embedding the blade in a supporting body that is in turn affixed to a shoe. The longitudinally extending passageway and member avoid the structural weaknesses of the prior art and permit the rigid and partial embedding of the blade in the supporting body.

8 Claims, 5 Drawing Figures

BLADE FOR ICE SKATES

BACKGROUND OF THE INVENTION

The present invention relates to a blade for ice skates, and, more particularly, to a blade which can be partially embedded in a supporting body of plastic material that is, in turn, affixed to a shoe for skating.

In the use of ice skates, each blade and its support are constantly subjected to pressures that depend in severity upon the particular activity for which the skates are used. The pressures are particularly severe, for example, when the skates are used for ice hockey.

The resulting pressures have an adverse effect on the supporting body of each skate, particularly in the connection of the support body and the blade. To realize a suitable blade-support combination, it is necessary to select an appropriate plastic material for the support, and, in particular, an appropriate anchorage of the blade to the support.

In one prior art technique for attempting to realize an anchorage that can withstand rough treatment, a support body had been molded directly over the blade, with a plurality of transverse links between the blade and the support. For that purpose, the blade is provided, along a side that is embedded in the support, with a number of transverse holes of various forms and more or less regular distribution. The dimensions of the holes are chosen to facilitate the flow of fluid or semi-fluid plastic material that forms the desired links when the plastic becomes cold.

In another prior art technique for attempting to achieve a suitable anchorage, the upper edge of the blade that is embedded in the support is provided with a plurality of protuberances, each essentially in the form of a "T" with wings parallel to the edge to form passages. These serve to provide transverse links that correspond to those provided by the holes mentioned above. This last technique, using "T" wings provides better anchorage between the blade and the support body than does the use of apertures alone.

Both techniques, however, present a technical difficulty not heretofore overcome. Considering the high temperatures used during the molding of the support, the shrinkage of the selected plastic material during cooling, and the presence of transverse links realized in corresponding positions at opposite extremities of the blade, internal stresses are produced which are localized near the blade or passages of the blade. As a consequence during use of skates that are produced in a conventional way relatively minor pressures can cause the formation of cracks that can rapidly lead to a fracture.

SUMMARY OF THE INVENTION

The invention provides an ice skating blade that is anchored to a support in a way that overcomes the difficulties mentioned above.

In accordance with the invention, the portion of an ice skating blade that is anchored by being imbedded in a support is provided in the proximity of its upper edge with a transverse passageway and at least one coupling instrumentality. Both the passageway and the coupling instrumentality desirably extend longitudinally in the direction of the upper edge of the blade.

According to one realization of the invention, the transverse passageway is in a central portion of the blade near its upper edge. The coupling instrumentality can take the form of a projection at an extremity of the blade, or two projections at opposite extremities of the blade. In the latter case, the projections are turned towards the transverse passage in parallel alignment with the upper edge of the blade. The coupling instrumentality may also take the form of one or more longitudinally extending grooves positioned near the upper, embeddable edge of the blade.

The transverse passage can be in the body of the blade or in a projection of the blade above its upper edge. The projection containing the passageway can be at an extremity or an intermediate position.

The principal advantage of the invention is that the anchorage of the blade to the supporting body is insured with transversal tightness between the blade and the body. During the cooling of the plastic material chosen for the supporting body, the material shrinks in a longitudinal direction with respect to the blade in such a way that there is an apparent absence of any zones of undesired stress.

DESCRIPTION OF THE DRAWINGS

Other characteristics of the invention will become apparent from a description of several realizations of a blade for ice skates with reference to, but not limited to, embodiments described below.

DETAILED DESCRIPTION

Figure 1:
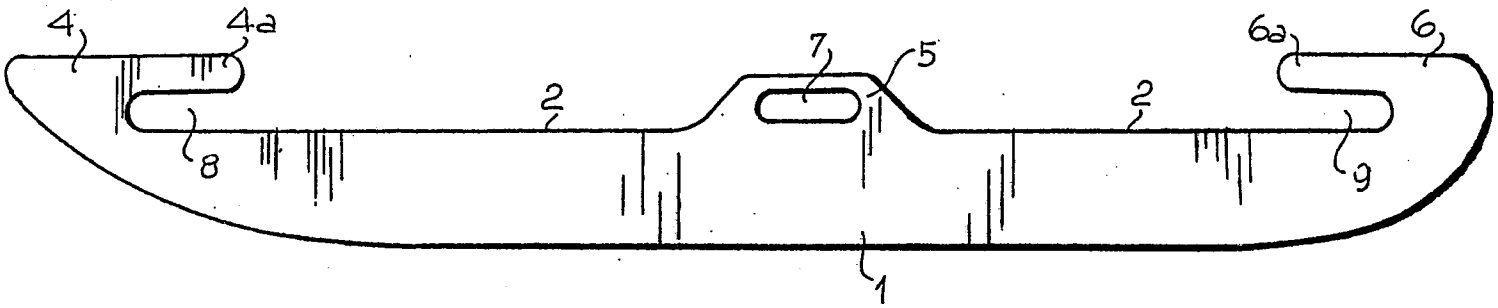
FIG. 1 represents a side view of a first realization of a blade for ice skates according to the invention.
Figure 2:
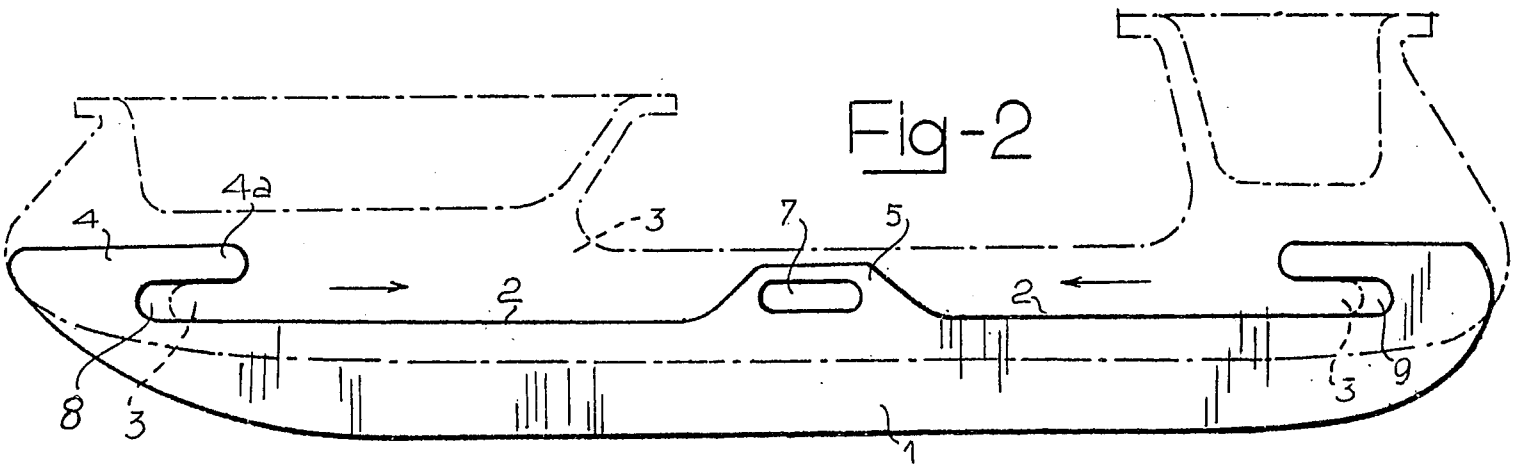
FIG. 2 represents the blade of FIG. 1 anchored to a support body shown in phantom.

With reference to FIGS. 1 and 2, an ice skating blade 1 according to the invention is shown with an edge 2 and associated structure to be embedded in a support 3 (in phantom) realized using an appropriate plastic material.

Along the edge 2 the blade 1 has three projection portions 4, 5 and 6 of which the intermediate portion 5 has a transverse passage or hole 7 of prescribed form. The particular passage 7 is oblong with major axis extending longitudinally in alignment with the edge 2. The remaining projections 4 and 6 are formed at counterpart extremities of the blade and define respective appendages 4*a* and 6*a*. The appendages extend toward the intermediate projection 5 in parallel alignment with associated portions of the edge 2 of the blade 1.

The appendages 4*a* and 6*a* have a prescribed length in accordance with the coefficient of shrinkage of the plastic material chosen for realization of the supporting base 3. The appendages are separated from edge 2 of the blade 1 to form respective oblong passages 8 and 9 of prescribed width. As illustrated in FIG. 1 the passages 8 and 9 desirably have substantially the same width and length as the transverse passage 7. The illustrated length of each passage is about eight percent of the overall length of the blade 1.

The blade 1 described above is rigidly fixed in the supporting body 3 by molding. During the molding operation, which is completely conventional, plastic material in fluid form engulfs the projections 4 and 6 with their respective appendages 4*a* and 6*a*, the intermediate projection 5 and parts of the blade in proximity to the edge 2. This completely fills the hole 7 of the intermediate portion 5 and the passage 8 and 9 of the appendages 4 and 6. As indicated in FIG. 2, the overlap of the plastic material from the edge 2 along the lateral faces of the blade 1 is advantageously approximately the same as the widths of the passages 7, 8, and 9.

During the subsequent cooling of the molded plastic material and its consolidation into the support 3, there is an attendant shrinkage of the plastic. Because of the oblong form of the support body 3, the fixed transverse and oblong passages formed between the support and the blade 1 and the partial embedding of the blade in the body in correspondence with the hole 7 of the intermediate projection 5, the blade resists the phenomenon of shrinkage corresponding to the movement of the material from the extremity of the support body 3 towards its central portion. This movement is not absolutely stopped by the configuration of the blade but is guided, particularly for the plastic material contained between the appendages 4*a* and 6*a* and the edge 2 of the blade, so that internal localized stresses are avoided in the support body 3.

In other words, an anchorage with the desired resistance characteristic is insured by the complete embedding of the appendages 4*a* and 6*a* of the projections 4 and 6 and the intermediate projection 5, along with the realization of transverse links by the solidification of plastic material in the passage 7 of the projection 5.

The length of each of the appendages 4*a* and 6*a* associated with the projections 4 and 6 is chosen so that when there is consolidation of the supporting body, notwithstanding the effects of shrinkage of the plastic material in the directions indicated by the arrows, leaving voids in the passages 8 and 9 as shown in FIG. 2, the appendages are nevertheless totally embedded in the body 3.

Figures 3, 4, 5:
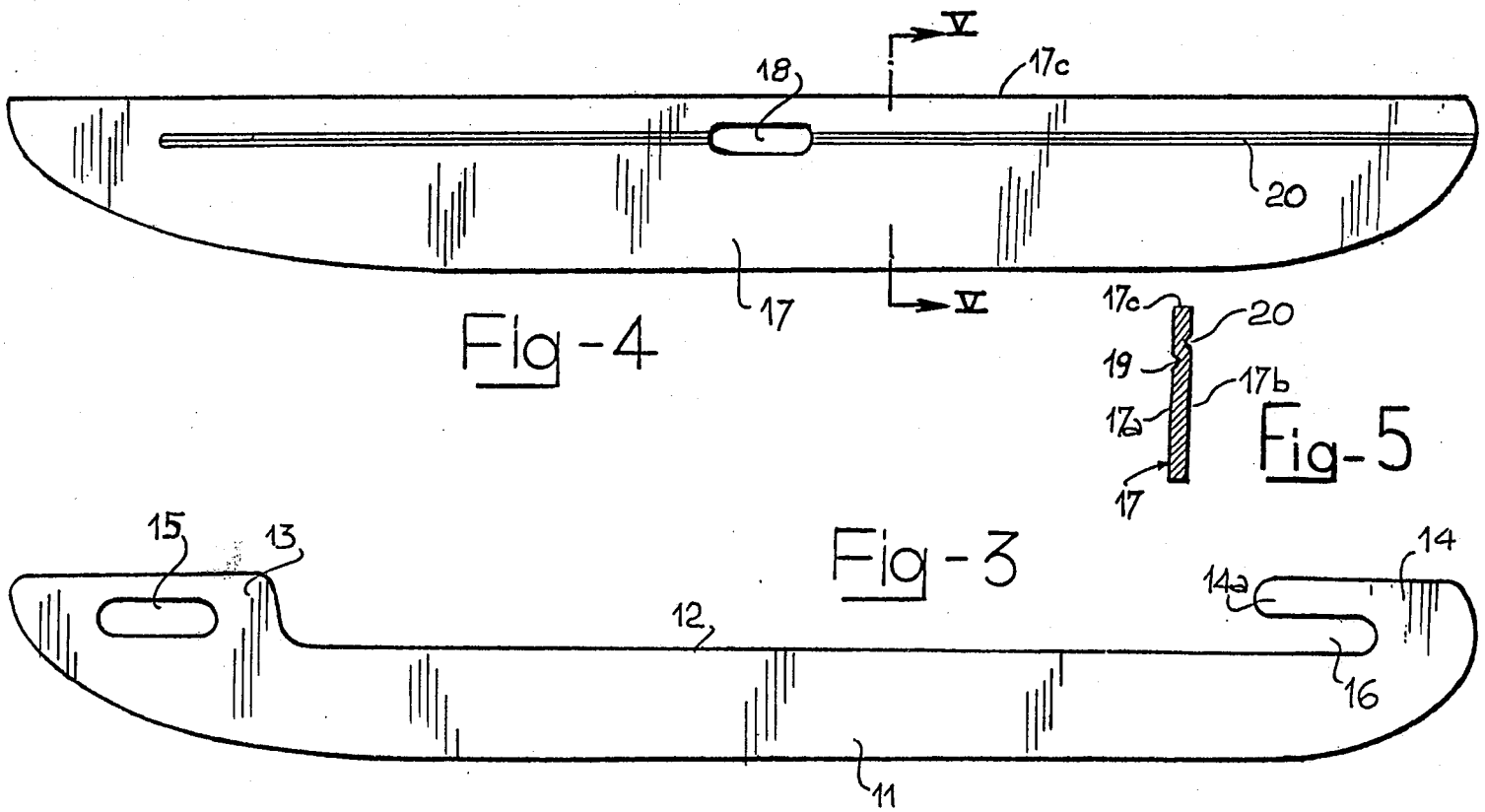
FIGS. 3 and 4 represent two alternative variations of the blade of FIG. 1.
FIG. 5 is a sectional view of the blade of FIG. 4 taken along the line V—V.

In FIG. 3 there is illustrated a variant ice skating blade of the invention. With reference to that figure, a blade 11 intended to be partially embedded in the body (not shown) of plastic material is equipped along an edge 12 with projection portions 13 and 14 at corresponding opposite extremities. The portion 13 is pierced by a hole 15, preferably oblong, while the projection 14 forms an appendage 14*a* turned towards the portion 13 extending parallel to and in alignment with the edge 12 of the blade. Between the appendage 14 and the edge 12 there is formed a passage 16 of prescribed length and width, which is advantageously similar to that of the passage 15.

With reference to FIGS. 4 and 5 there is illustrated an alternative form of the invention. The blade 17 is provided with a hole 18 in its central portion. On opposite sides 17*a* and 17*b* of the blade 17, as further indicated in the cross-sectional view of FIG. 5, there is an anchorage in the form of corresponding grooves 19 and 20 which extend parallel to the upper edge 17*c* of the blade in prescribed relation and distance with respect to it. The grooves 19 and 20, for example produced by milling, are dimensioned for hooking together the plastic material of the support body (not shown) during molding directly with the blade 17. They confine the shrinkage to movement in the desired longitudinal direction.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. An ice skating blade for embedding in a supporting body of plastic material by which the blade is affixed to a shoe for skating, comprising an upper, embeddable edge, and a transverse longitudinally closed and rounded passageway in the vicinity of said upper edge; said passageway having a greater longitudinal length than vertical height to provide for the shrinkage of said plastic material; and means extending longitudinally with respect to said edge and forming an open projection at the same level as said transverse passageway said projection forming an anchoring means for anchoring said blade in said supporting body.

2. A blade in accordance with claim 1 wherein said passageway is formed in a central portion of said blade.

3. A blade in accordance with claim 2 wherein said passageway is located in a projection above said edge.

4. A blade in accordance with claim 1 wherein said passageway is located at an extremity of said blade.

5. A blade in accordance with claim 1 wherein the anchoring means comprises an appendage at an extremity of said blade extending towards said passageway parallel to said edge.

6. A blade in accordance with claim 5 wherein said anchoring means comprises an appendage at each extremity of said blade.

7. A blade in accordance with claim 1 wherein said transverse passageway is centrally located in a projection above said edge;

the anchoring means comprises an appendage connected at each extremity of said blade, spaced from and aligned with said edge and parallel thereto and extending towards said transverse passageway and providing a further passage between said appendage and said edge.

8. A blade in accordance with claim 7 wherein each passage is oblong with a length about three times its width.

* * * * *